US011619401B2

(12) United States Patent
Peng

(10) Patent No.: US 11,619,401 B2
(45) **Date of Patent: *Apr. 4, 2023**

(54) INSTANT HOT WATER DISPENSER SYSTEM

(71) Applicant: Shao-Yu Peng, Changhua County (TW)

(72) Inventor: Shao-Yu Peng, Changhua County (TW)

( * ) Notice: Subject to any disclaimer, the term of this patent is extended or adjusted under 35 U.S.C. 154(b) by 490 days.

This patent is subject to a terminal disclaimer.

(21) Appl. No.: 16/712,991

(22) Filed: Dec. 13, 2019

(65) Prior Publication Data

US 2020/0191414 A1 Jun. 18, 2020

(30) Foreign Application Priority Data

Dec. 14, 2018 (TW) ..... 107217063

(51) Int. Cl.
*F24D 19/10* (2006.01)
*F24H 9/20* (2022.01)
*E03C 1/044* (2006.01)

(52) U.S. Cl.
CPC ..... *F24D 19/1051* (2013.01); *E03C 1/044* (2013.01); *F24H 9/2014* (2013.01); *F24D 2220/042* (2013.01)

(58) Field of Classification Search
None
See application file for complete search history.

(56) References Cited

U.S. PATENT DOCUMENTS 2,694,768 A * 11/1954 Stiebel ..... F24H 1/102 392/474
3,468,292 A * 9/1969 Ferraro ..... F24H 1/225 122/33
3,952,182 A * 4/1976 Flanders ..... G05D 23/1912 392/466
4,077,545 A * 3/1978 Karls ..... E03C 1/0411 137/339
5,317,670 A * 5/1994 Elia ..... F24D 19/1051 126/362.1
5,417,348 A * 5/1995 Perrin ..... B67D 1/0059 137/606
6,175,689 B1 * 1/2001 Blanco, Jr. ..... F24H 1/102 392/474
6,240,250 B1 * 5/2001 Blanco, Jr. ..... F24H 1/102 392/474

(Continued)

*Primary Examiner* — Thor S Campbell
(74) *Attorney, Agent, or Firm* — Bruce Stone LLP; Joseph A. Bruce

(57) ABSTRACT

An instant hot water dispenser system includes a main body, having a water flow control valve seat, a water inlet and a water outlet, the water flow control valve seat being provided with a first flow control valve and a second flow control valve; a faucet being provided with a first pull member, a second pull member and a water outlet pipe; a first heating unit having a first water storage space and a heater; a second heating unit having a circulating water path and an instantaneous heater, the instantaneous heater being configured to instantaneously heat a water supply in the circulating water path to a predetermined temperature; a processing unit electrically connected to a control interface, the processing unit being further electrically connected to the water flow control valve seat, the first heating unit and the second heating unit.

9 Claims, 8 Drawing Sheets

(56) References Cited

U.S. PATENT DOCUMENTS

| | | | | |
|---|---|---|---|---|
| 6,246,831 | B1 * | 6/2001 | Seitz | F24H 9/2021 219/483 |
| 7,264,016 | B2 * | 9/2007 | Molina | E03C 1/04 137/454.6 |
| 7,773,868 | B2 * | 8/2010 | Moore | F24D 19/1051 392/490 |
| 8,165,461 | B2 * | 4/2012 | Sullivan | F24H 1/142 392/485 |
| 8,304,699 | B2 * | 11/2012 | Fliess | B67D 1/0888 219/509 |
| 8,346,069 | B2 * | 1/2013 | Yeung | F24H 1/121 392/491 |
| 8,768,154 | B2 * | 7/2014 | Nakagawa | F24H 9/2028 392/485 |
| 8,787,742 | B2 * | 7/2014 | Lutz | F24H 1/102 392/451 |
| 8,971,694 | B2 * | 3/2015 | Deivasigamani | G06F 16/9574 392/308 |
| 9,958,075 | B2 * | 5/2018 | Rowe | F16K 11/207 |
| 11,131,086 | B2 * | 9/2021 | Frackelton | G05D 23/1353 |
| 2004/0079426 | A1 * | 4/2004 | Hung | E03C 1/0404 137/801 |
| 2010/0195991 | A1 * | 8/2010 | Deivasigamani | F24H 9/2035 392/308 |
| 2016/0187895 | A1 * | 6/2016 | Brenner | F24D 17/0078 137/565.01 |
| 2018/0186655 | A1 * | 7/2018 | Cobb | C02F 1/003 |
| 2018/0216322 | A1 * | 8/2018 | Tang | F24D 17/0005 |
| 2019/0078794 | A1 * | 3/2019 | Heo | F24D 17/0094 |
| 2020/0191412 | A1 * | 6/2020 | Kim | F24D 3/02 |
| 2021/0052106 | A1 * | 2/2021 | Mckay | B67D 1/0864 |

* cited by examiner

INSTANT HOT WATER DISPENSER SYSTEM

FIELD OF THE INVENTION

The present invention relates to a water dispenser system, and more particularly to an instant hot water dispenser system.

BACKGROUND OF THE INVENTION

Water is one of the important constituents of the human body. For example, blood, lymph fluid and secretions of the human body are all related to water. Water accounts for about 70% of an adult's body weight. The water content in the blood is more than 90%. When we eat foods, digestion, transport of nutrients and waste excretion need the help of water to proceed smoothly. Water can lubricate joints and prevent eyeballs from drying out. Saliva and gastric juice can help digestion. Water also regulates body temperature, removing excess heat from the body through perspiration. Drinking more water can reduce uric acid and prevent gout, and it can also reduce the calcium concentration in the urine and avoid urinary tract stones. Therefore, the daily amount of water intake should be within the range of 2000-3000 cc.

However, the general domestic tap water mainly includes three stages, namely, collection, purification and water distribution. Although abnormalities in the water flowing to the home cannot be seen with the naked eye, the pollution gradually accumulates in these three stages. For the above reasons, some homes are equipped with boiling and filtering water dispensers. In general, water dispensers on the market usually use a hot water storage container and a heating device to provide high-temperature hot water. After the hot water in the water storage container is used up, the hot water cannot flow out of the water outlet. The water dispenser needs to refill with cold water in the water storage bucket and complete the boiling process before the water dispenser can provide hot water. This deficiency in the current system needs to be improved.

Accordingly, the inventor of the present invention has devoted himself based on his many years of practical experiences to solve these problems.

SUMMARY OF THE INVENTION

The primary object of the present invention is to provide an instant hot water dispenser system.

In order to achieve the aforesaid object, the instant hot water dispenser system, comprises a main body, a faucet, a first heating unit, a second heating unit, a plurality of temperature sensor, and a processing unit.

The main body has a water flow control valve seat, a water inlet and a water outlet. The water flow control valve seat is provided with a first flow control valve and a second flow control valve. One end of the water inlet is connected to a tap water pipeline. Another end of the water inlet is connected to a chamber of the water flow control valve seat. The chamber communicates with the first flow control valve and the second flow control valve. The second flow control valve communicates with a first water inlet of a water collection device. The water outlet communicates with the faucet through a water pipeline.

The faucet is provided with a first pull member, a second pull member and a water outlet pipe. The first pull member is configured to control a water supply sent from the tap water pipeline to the water outlet pipe. The second pull member is configured to control a water supply sent from the water outlet to the water outlet pipe.

The first heating unit has a first water storage space and a heater. One side of the first water storage space communicates with the first flow control valve. Another side of the first water storage space communicates with the second water inlet of the water collection device. The heater is configured to preheat a water supply in the first water storage space to a predetermined temperature.

The second heating unit has a circulating water path and an instantaneous heater. One side of the circulating water path communicates with a third water outlet of the water collection device. Another side of the circulating water path communicates with the water outlet of the main body. The instantaneous heater is configured to instantaneously heat a water supply in the circulating water path to a predetermined temperature.

The plurality of temperature sensors are respectively disposed on the water flow control valve seat, the first heating unit, the third water outlet of the water collection device and the water outlet of the main body for sensing temperatures of the water supplies and sending a signal of the temperatures of the water supplies to the processing unit.

The processing unit is electrically connected to a control interface and an external power source. The processing unit is further electrically connected to the water flow control valve seat, the first heating unit and the second heating unit.

Preferably, a water filtering device is provided between the water inlet of the main body and the tap water pipeline.

Preferably, the second pull member includes a safety switch. The safety switch is a spring rod. After the spring rod is pressed down, a bottom of the spring rod is engaged with an engaging hole so that the second pull member can be slightly rotated about an axis.

Preferably, the second pull member includes a micro switch. The micro switch is electrically connected to the processing unit. When the second pull member is slightly rotated to a predetermined position, the micro switch starts the processing unit.

Preferably, the first heating unit and the second heating unit further include a plurality of temperature protection switches.

Preferably, the control interface is provided with a water-dispensing button, a temperature button, a number button, a temperature display, a water volume display, and a status display of a water filtering device.

Preferably, when the processing unit receives a water-dispensing temperature signal from the control interface and determines that the water-dispensing temperature signal is less than 40° C., the second flow control valve is opened, and the water supply in the chamber is sent to the water outlet through the water collection device and the second heating unit.

Preferably, when the processing unit receives a water-dispensing temperature signal from the control interface and determines that the water-dispensing temperature signal is 40° C.-85° C., the second flow control valve and the second water inlet of the water collection device are opened, and the water supply in the chamber and the water supply in the first water storage space are mixed to meet the water-dispensing temperature signal through the water collection device and then sent to the water outlet.

Preferably, when the processing unit receives a water-dispensing temperature signal from the control interface and determines that the water-dispensing temperature signal is above 85° C., the second water inlet of the water collection device is opened, and the water supply in the first water storage space is sent through the water collection device to the circulating water path of the second heating unit for heating, when the temperature of the water supply reaches the water-dispensing temperature signal, the water supply is sent to the water outlet.

DETAILED DESCRIPTION OF THE PREFERRED EMBODIMENTS

Figure 1:
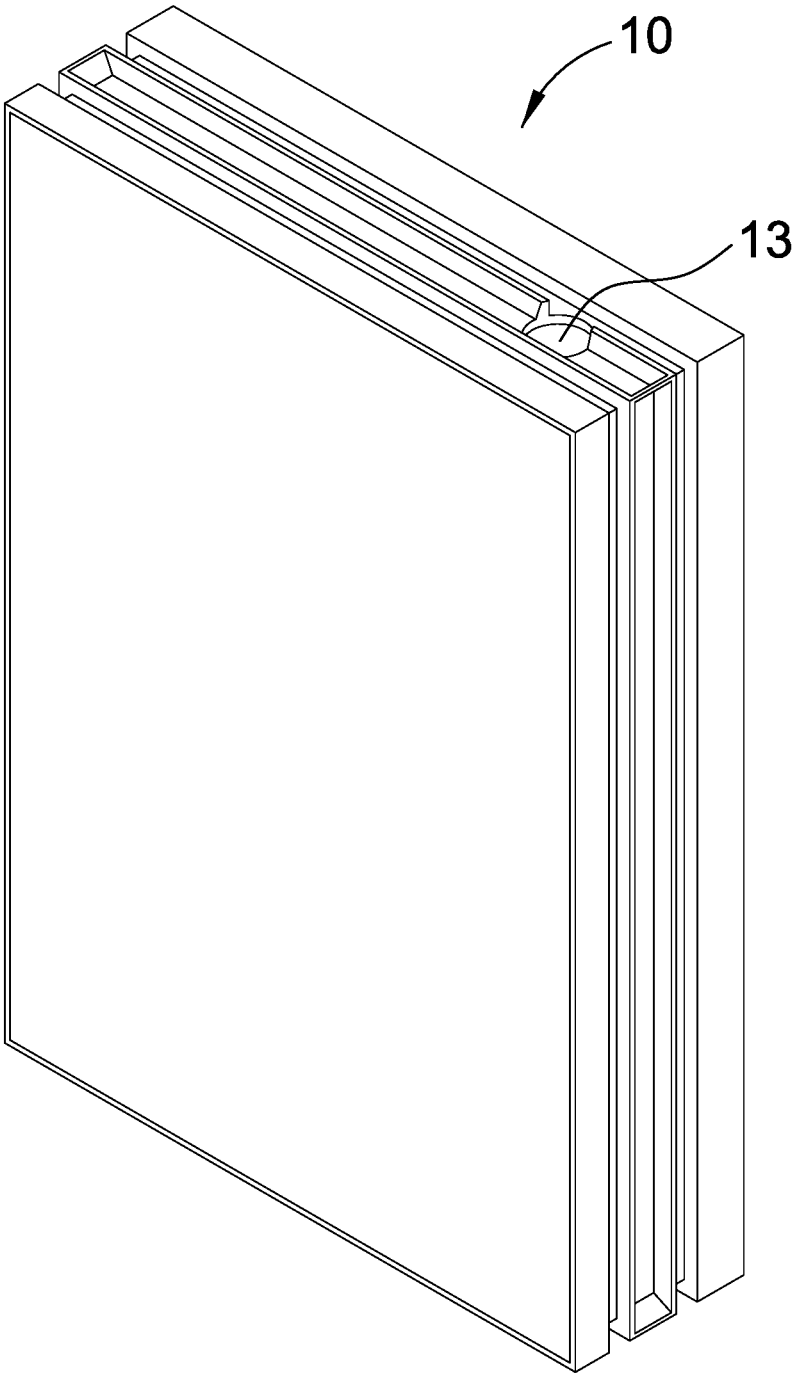
FIG. 1 is a perspective view of the main body of the instant hot water dispenser system of the present invention.
Figure 2:
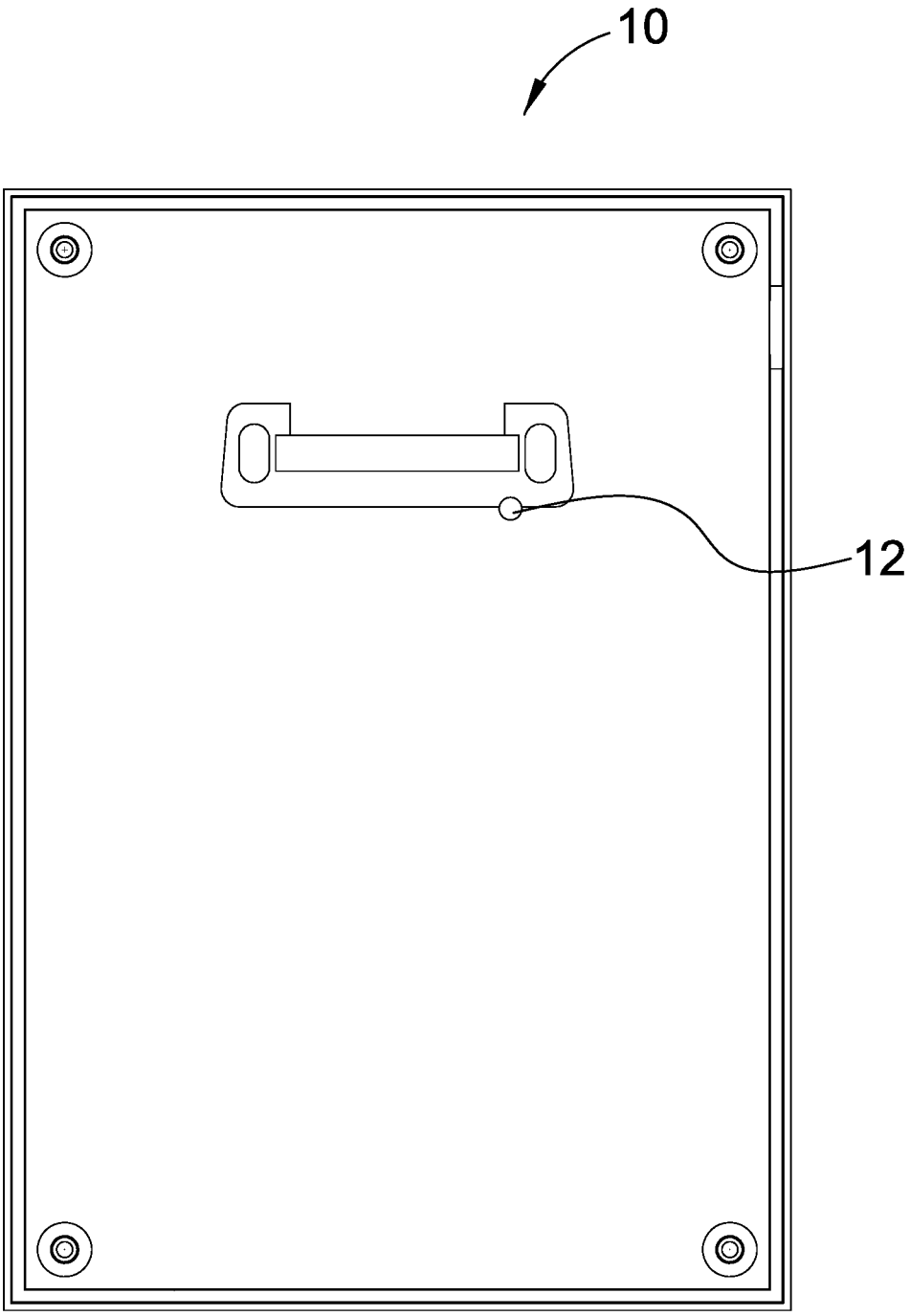
FIG. 2 is a rear view of the main body of the instant hot water dispenser system of the present invention.

Referring to FIG. 1 through FIG. 5, the present invention discloses an instant hot water dispenser system, comprising a main body 10, a first heating unit 30, a second heating unit 40, a processing unit 50, a plurality of temperature sensor 60, and a faucet 90.

The main body 10 has a water flow control valve seat 11, a water inlet 12, and a water outlet 13. The water flow control valve seat 11 is provided with a first flow control valve 111 and a second flow control valve 112. One end of the water inlet 12 is connected to a tap water pipeline through a water pipeline, and another end of the water inlet 12 is connected to a chamber 113 of the water flow control valve seat 11. The chamber 113 communicates with the first flow control valve 111 and the second flow control valve 112. The second flow control valve 112 communicates with a first water inlet 21 of a water collection device 20. The water outlet 13 communicates with the faucet 90 through the water pipeline. A water filtering device 70 is provided between the water inlet 12 of the main body 10 and the tap water pipeline.

The faucet 90 is provided with a first pull member 91, a second pull member 92, and a water outlet pipe 93. The first pull member 92 is configured to control the water supply sent from the tap water pipeline to the water outlet pipe 93. The second pull member 92 is configured to control the water supply sent from the water outlet 13 to the water outlet pipe 93.

The first heating unit 30 has a first water storage space 31 and a heater. One side of the first water storage space 31 communicates with the first flow control valve 111, and another side of the first water storage space 31 communicates with the second water inlet 22 of the water collection device 20. The heater is configured to preheat the water supply in the first water storage space 31 to a predetermined temperature (the preset value is 85° C.).

The second heating unit 40 has a circulating water path 41 and an instantaneous heater. One side of the circulating water path 41 communicates with a third water outlet 23 of the water collection device 20, and another other side of the circulating water path 41 communicates with the water outlet 13 of the main body 10. The instantaneous heater is configured to instantaneously heat the water supply in the circulating water path 41 to a predetermined temperature.

The first heating unit 30 and the second heating unit 40 further include a plurality of temperature protection switches 80. If the first heating unit 30 or the second heating unit 40 is abnormal and the water temperature exceeds a preset value (such as a temperature above 110° C.), the processing unit 50 immediately command the first heating unit 30 or the second heating unit 40 to stop heating.

The processing unit 50 is electrically connected to a control interface 51 and an external power source 52. The processing unit 50 is further electrically connected to the water flow control valve seat 11, the first heating unit 30 and the second heating unit 40. The control interface 51 is provided with a water-dispensing button, a temperature button, a number button, a temperature display, a water volume display, and a status display of the water filtering device 70.

The plurality of temperature sensors 60 are respectively disposed on the water flow control valve seat 11, the first heating unit 30, the third water outlet 23 of the water collection device 20 and the water outlet 13 of the main body 10 for sensing the temperatures of the water supplies and sending a signal of the temperatures of the water supplies to the processing unit 50.

Embodiments of the present invention will now be described, by way of example only, with reference to the accompanying drawings.

Figure 3:
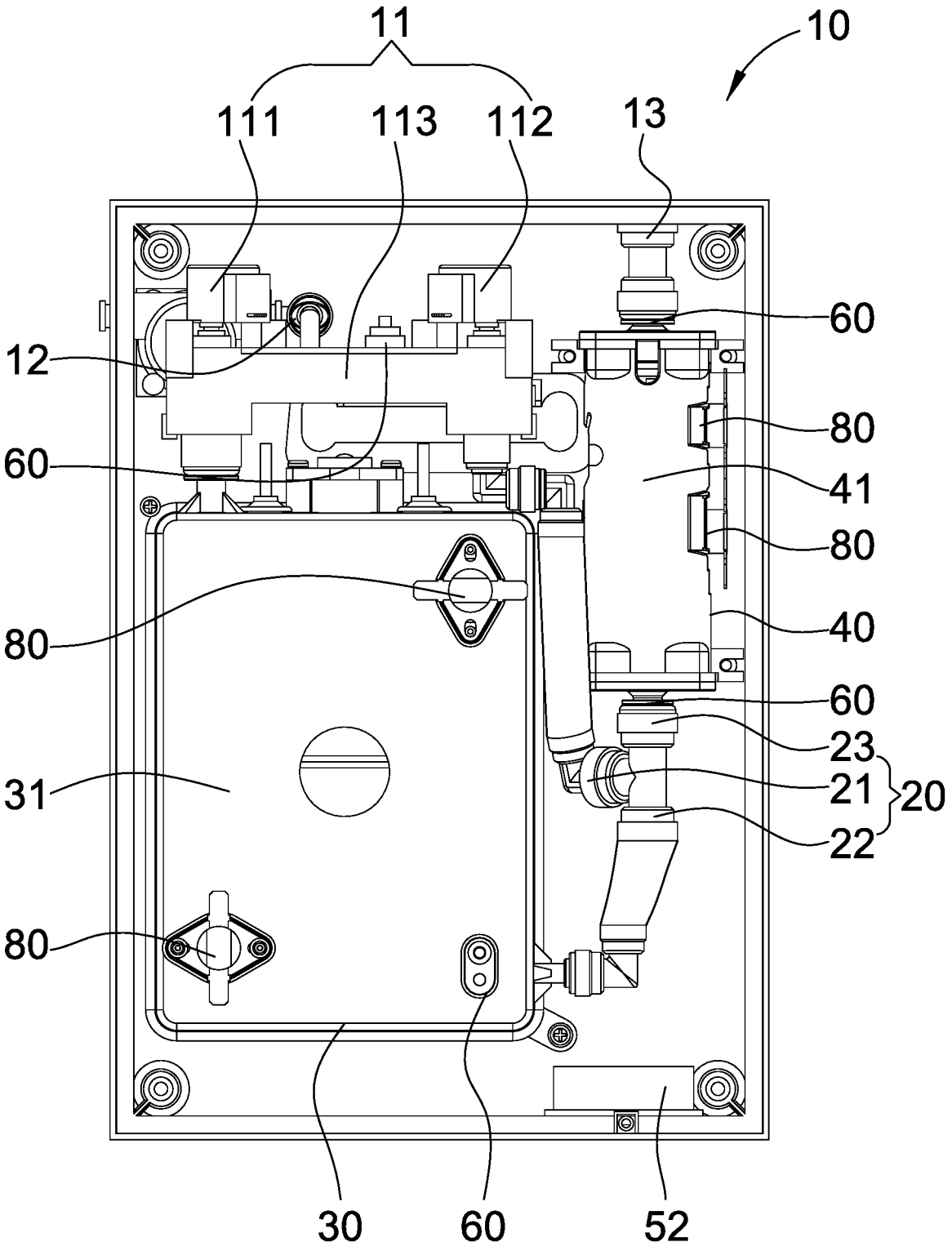
FIG. 3 is a view showing the internal parts of the main body of the instant hot water dispenser system of the present invention.
Figure 4:
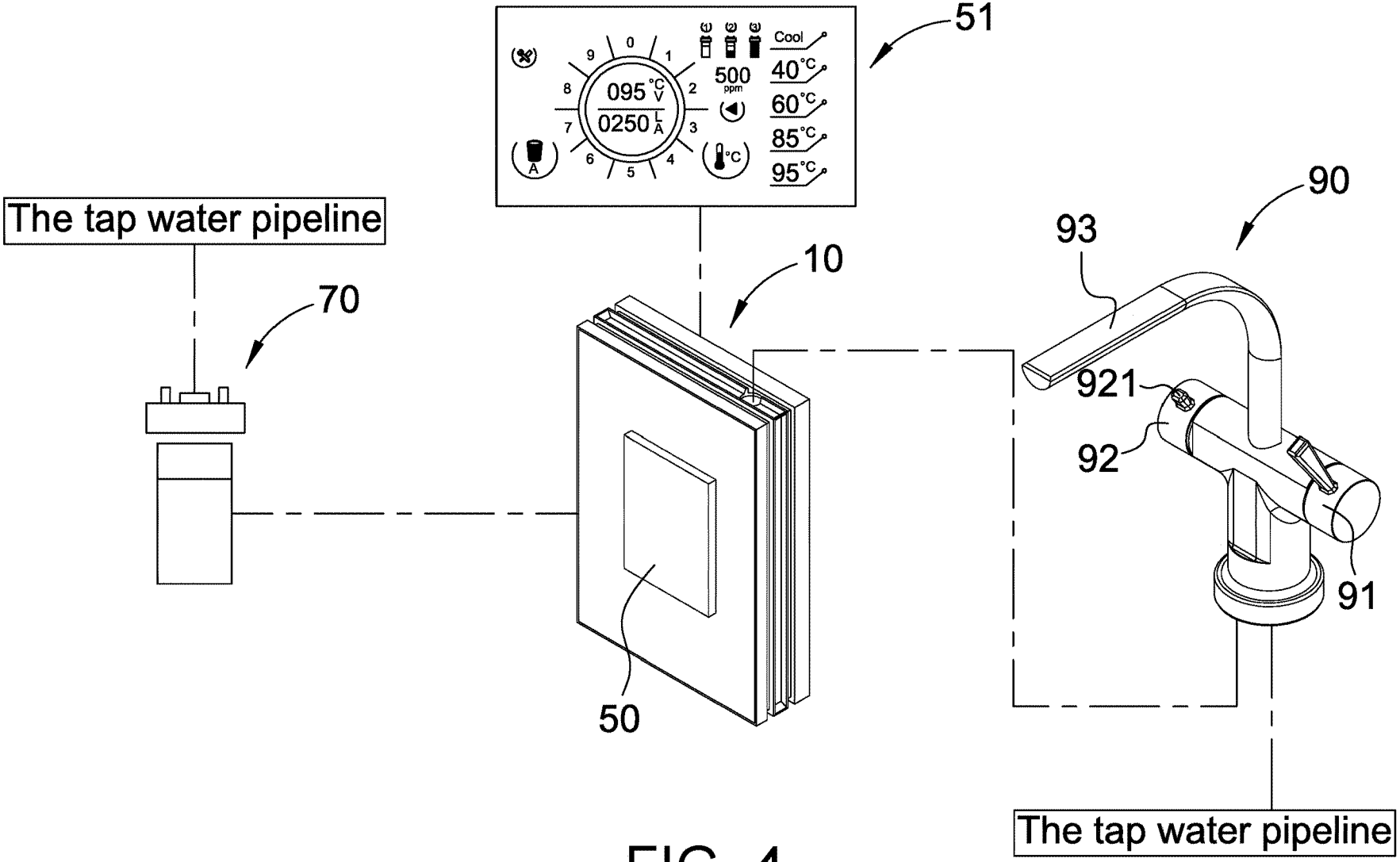
FIG. 4 is a view of the instant hot water dispenser system of the present invention.
Figure 5:
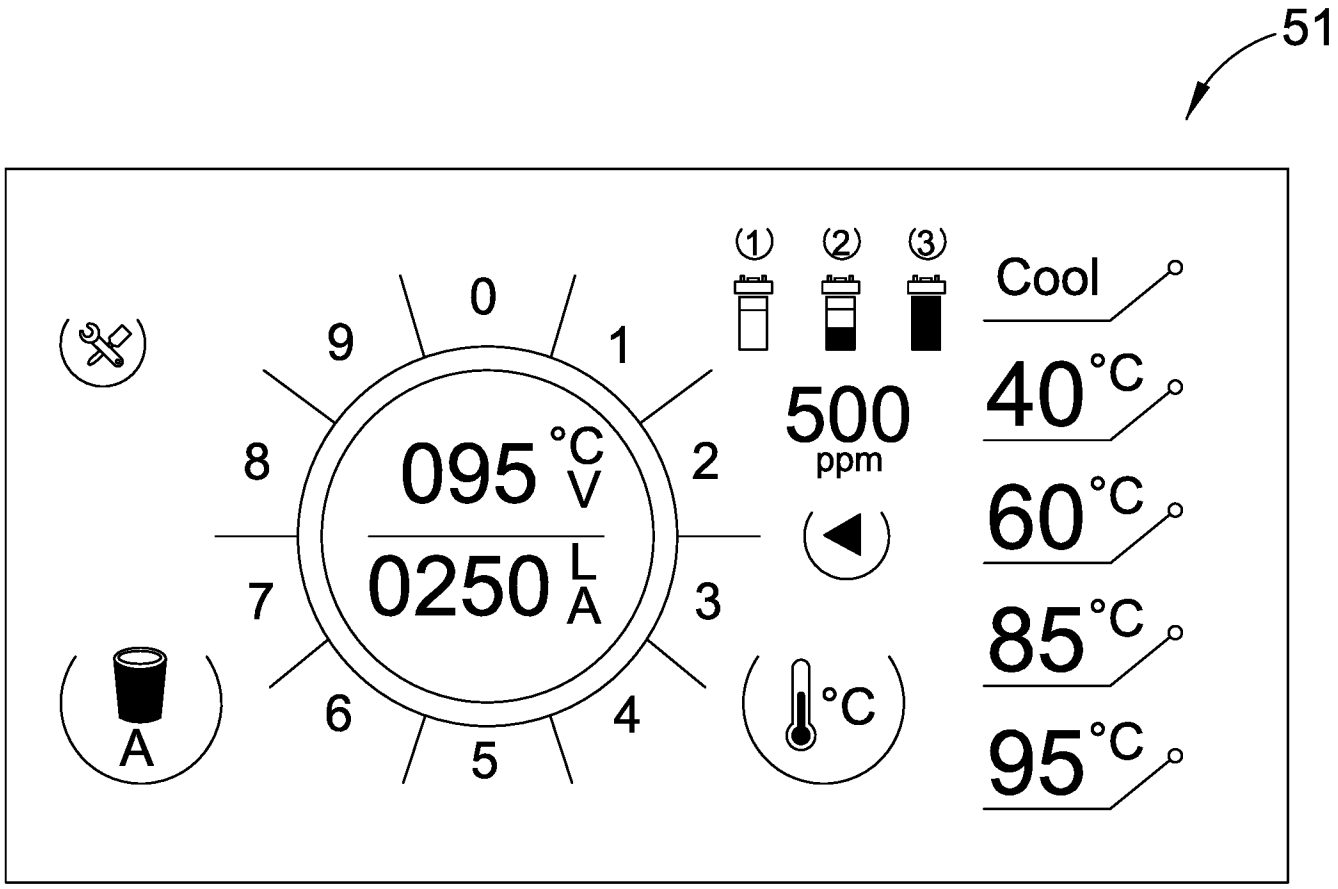
FIG. 5 is a view of the control interface of the instant hot water dispenser system of the present invention.
Figure 6:
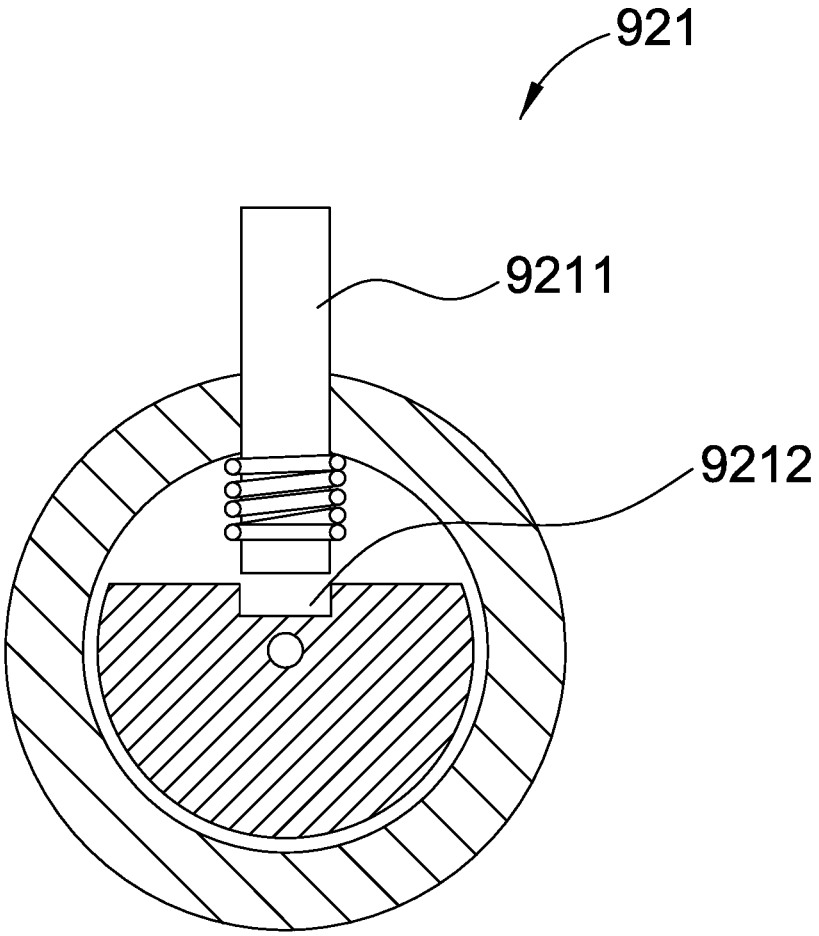
FIG. 6 and FIG. 7 are cross-sectional views of the second pull member of the instant hot water dispenser system of the present invention.
Figure 7:
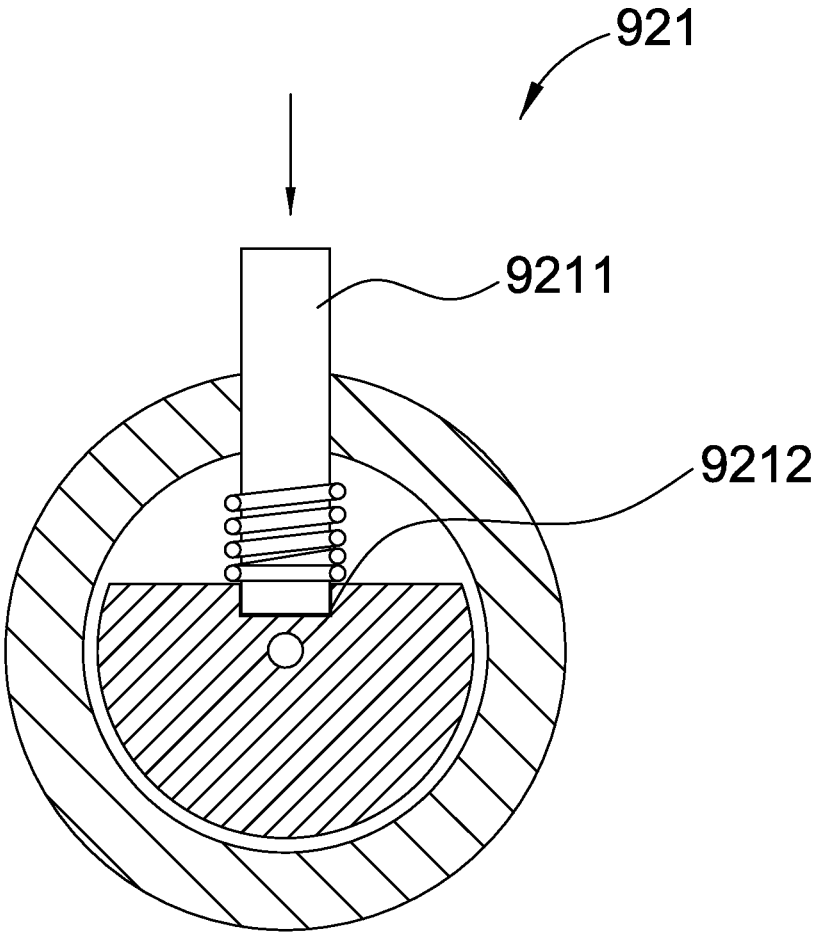
Figure 8:
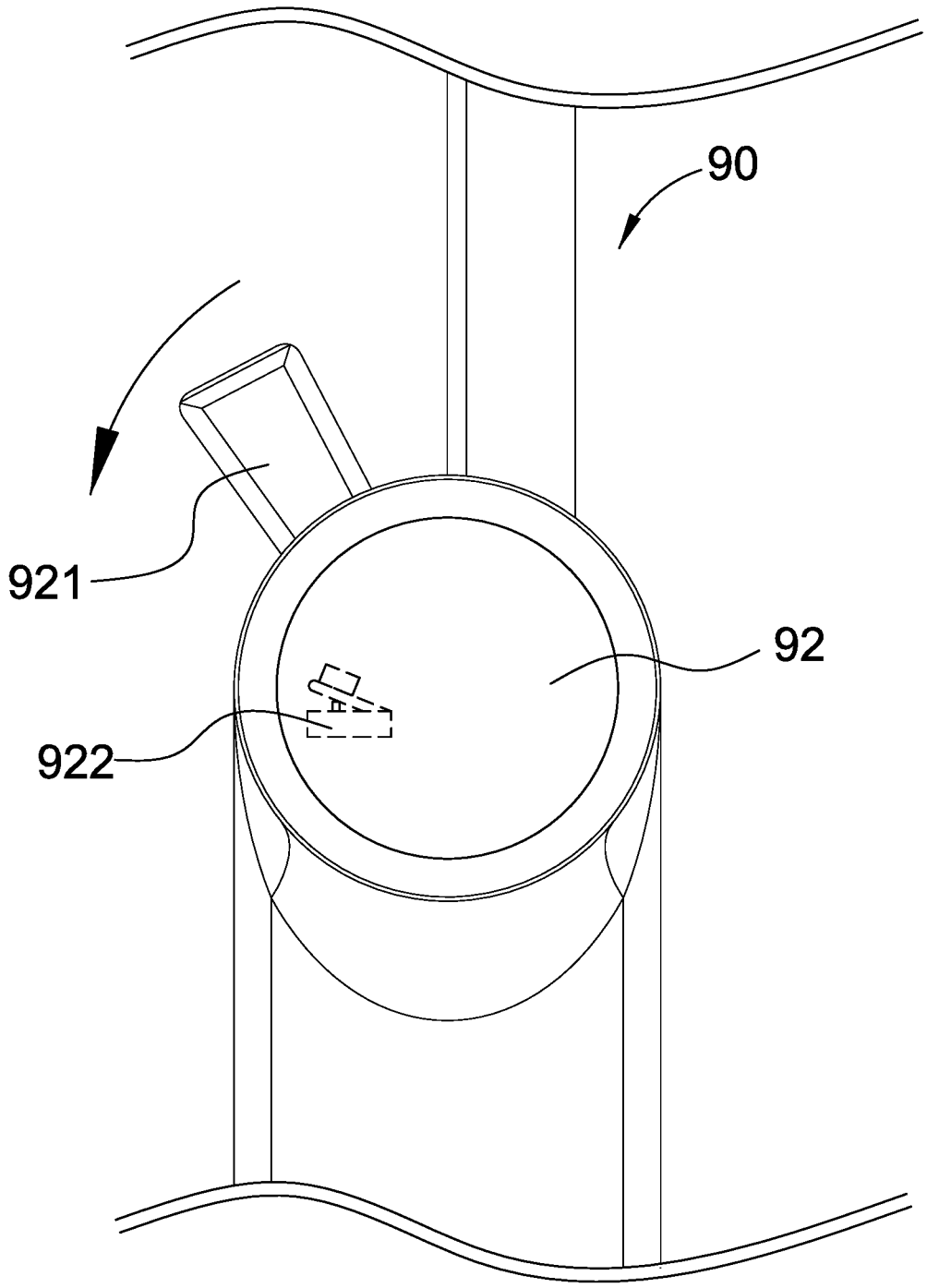
FIG. 8 is a view of the instant hot water dispenser system of the present invention, showing that the second pull member is rotated to touch the micro switch.

Referring to FIG. 3 and FIG. 8, when the user wants to drink drinking water (40° C.), first, the user presses a spring rod 9211 on a safety switch 921 to slightly rotate the second puller member 92 to a predetermined position and touches a micro switch 922 to start the processing unit 50. At this time, the user elects and presses the temperature button (40° C.) on the control interface 51. When the processing unit 50 receives the water-dispensing temperature signal from the control interface 51 and determines that the water-dispensing temperature signal is 40° C., the second flow control valve 112 is opened, and the water supply in the chamber 113 is sent to the water collection device 20. If the temperature sensor 60 on the water collection device 20 detects that the temperature is less than 40° C., the water supply is sent to the circulating water path 41 in the second heating unit 40 for heating instantaneously. Finally, the water supply flows from the water outlet 13 to the water outlet pipe 93 of the faucet 90 through the water outlet pipe, so as to supply drinking water (40° C.) immediately.

When the user wants to drink drinking water (60° C.), first, the user presses the spring rod 9211 on the safety switch 921 to slightly rotate the second puller member 92 to a predetermined position and touches the micro switch 922 to start the processing unit 50. At this time, the user elects and presses the temperature button (60° C.) on the control interface 51. When the processing unit 50 receives the water-dispensing temperature signal from the control interface 51 and determines that the water-dispensing temperature signal is 60° C., the second flow control valve 112 and the second water inlet 22 of the water collection device 20 are opened to mix the water supply in the chamber 113 and the water supply in the first water storage space 31 through the water collection device 20 to be at a temperature of 60° C. Finally, the water supply flows from the water outlet 13 to the water outlet pipe 93 of the faucet 90 through the water outlet pipe, so as to supply drinking water (40° C.) immediately.

When the user wants to drink drinking water (95° C.), first, the user presses the spring rod 9211 on the safety switch 921 to slightly rotate the second puller member 92 to a predetermined position and touches the micro switch 922 to start the processing unit 50. At this time, the user elects and presses the temperature button (95° C.) on the control interface 51. When the processing unit 50 receives the water-dispensing temperature signal from the control interface 51 and determines that the water-dispensing temperature signal is 95° C., the second water inlet 22 of the water collection device 20 is opened, and the water supply in the first water storage space 31 is sent to the circulating water path 41 of the second heating unit 40 via the water collection device 20 for heating. When the temperature of the water supply reaches 95° C., the water supply flows from the water outlet 13 to the water outlet pipe 93 of the faucet 90 via the water outlet pipe, so as to supply drinking water (95° C.) immediately.

The instant hot water dispenser system of the present invention has the following advantages:

1. The water supply with a medium-high temperature in the first water storage space 31 is sent to the circulating water path 41 of the second heating unit 40 for heating instantaneously. The water supply can be effectively heated to a specified high temperature in a short time.

2. Since the water supply in the first water storage space 31 is maintained at a medium-high temperature at any time, it can be continuously replenished to the circulating water path 41, and hot water above 95° C. is not easily consumed.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An instant hot water dispenser system, comprising:

a main body, having a water flow control valve seat, a water inlet and a water outlet, the water flow control valve seat being provided with a first flow control valve and a second flow control valve, one end of the water inlet being connected to a tap water pipeline, another end of the water inlet being connected to a chamber of the water flow control valve seat, the chamber communicating with the first flow control valve and the second flow control valve, the second flow control valve communicating with a first water inlet of a water collection device, the water outlet communicating with a faucet through a water pipeline;

the faucet being provided with a first pull member, a second pull member and a water outlet pipe, the first pull member being configured to control a water supply sent from the tap water pipeline to the water outlet pipe, the second pull member being configured to control a water supply sent from the water outlet to the water outlet pipe;

the first heating unit, having a first water storage space and a heater, one side of the first water storage space communicating with the first flow control valve, another side of the first water storage space communicating with the second water inlet of the water collection device, the heater being configured to preheat a water supply in the first water storage space to a predetermined temperature;

a second heating unit, having a circulating water path and an instantaneous heater, one side of the circulating water path communicating with a third water outlet of the water collection device, another side of the circulating water path communicating with the water outlet of the main body, the instantaneous heater being configured to instantaneously heat a water supply in the circulating water path to a predetermined temperature;

a processing unit, electrically connected to a control interface and an external power source, the processing unit being further electrically connected to the water flow control valve seat, the first heating unit and the second heating unit;

a plurality of temperature sensors, respectively disposed on the water flow control valve seat, the first heating unit, the third water outlet of the water collection device and the water outlet of the main body for sensing temperatures of the water supplies and sending a signal of the temperatures of the water supplies to the processing unit.

2. The instant hot water dispenser system as claimed in claim 1, wherein a water filtering device is provided between the water inlet of the main body and the tap water pipeline.

3. The instant hot water dispenser system as claimed in claim 1, wherein the second pull member includes a safety switch, the safety switch is a spring rod, after the spring rod is pressed down, a bottom of the spring rod is engaged with an engaging hole so that the second pull member can be slightly rotated about an axis.

4. The instant hot water dispenser system as claimed in claim 1, wherein the second pull member includes a micro switch, the micro switch is electrically connected to the processing unit, when the second pull member is slightly rotated to a predetermined position, the micro switch starts the processing unit.

5. The instant hot water dispenser system as claimed in claim 1, wherein the first heating unit and the second heating unit further include a plurality of temperature protection switches.

6. The instant hot water dispenser system as claimed in claim 1, wherein the control interface is provided with a water-dispensing button, a temperature button, a number button, a temperature display, a water volume display, and a status display of a water filtering device.

7. The instant hot water dispenser system as claimed in claim 1, wherein when the processing unit receives a water-dispensing temperature signal from the control interface and determines that the water-dispensing temperature signal is less than 40° C., the second flow control valve is opened, and the water supply in the chamber is sent to the water outlet through the water collection device and the second heating unit.

8. The instant hot water dispenser system as claimed in claim 1, wherein when the processing unit receives a water-dispensing temperature signal from the control interface and determines that the water-dispensing temperature signal is 40° C.-85° C., the second flow control valve and the second water inlet of the water collection device are opened, and the water supply in the chamber and the water supply in the first water storage space are mixed to meet the water-dispensing temperature signal through the water collection device and then sent to the water outlet.

9. The instant hot water dispenser system as claimed in claim 1, wherein when the processing unit receives a water-dispensing temperature signal from the control interface and determines that the water-dispensing temperature signal is above 85° C., the second water inlet of the water collection device is opened, and the water supply in the first water storage space is sent through the water collection device to the circulating water path of the second heating unit for heating, when the temperature of the water supply reaches the water-dispensing temperature signal, the water supply is sent to the water outlet.

* * * * *